US005281180A

United States Patent [19]

Lam et al.

[11] Patent Number: 5,281,180

[45] Date of Patent: Jan. 25, 1994

[54] TOY DOLL HAVING SOUND GENERATOR WITH OPTICAL SENSOR AND PRESSURE SWITCHES

[76] Inventors: Wing F. Lam, 50 Carl Crescent, Scarborough, Ontario, Canada, M1W 3K2; Yu F. Lam, 2/F., Flat C, Block 12, May Fair Garden, Tsing Yi Island, N.T., Hong Kong

[21] Appl. No.: 818,106

[22] Filed: Jan. 8, 1992

[51] Int. Cl.[5] ..... A63H 30/00; A63H 3/33

[52] U.S. Cl. ..... 446/175; 446/297; 446/302

[58] Field of Search ..... 446/175, 303, 297, 298, 446/299, 302, 295, 296

[56] References Cited

U.S. PATENT DOCUMENTS

| | | | |
|---|---|---|---|
| 4,451,911 | 5/1984 | Klose et al. | 446/303 X |
| 4,659,919 | 4/1987 | Price | 446/175 |
| 5,013,276 | 5/1991 | Garfinkel | 446/175 X |

FOREIGN PATENT DOCUMENTS

| | | | |
|---|---|---|---|
| 214013 | 3/1987 | European Pat. Off. | 446/297 |

*Primary Examiner*—Danton D. DeMille
*Attorney, Agent, or Firm*—Brian W. Gray; John C. Hunt

[57] ABSTRACT

A battery-powered doll which cries or laughs, depending upon how it has been stimulated. There is an optical sensor fixed in the mouth of the doll and connected to an integrated circuit located in the torso of the doll. When there is insufficient light striking the sensor, the doll cries through a speaker in the doll's torso. When the doll is subsequently brought into the light to sufficiently expose the sensor, the doll laughs for a short, but variable length of time. There is a first pressure actuated switch positioned in the doll's torso such that it may be actuated by a tickling type of pressure applied to the side of the torso. The doll laughs when this switch is actuated. There is a second pressure actuated switch in the doll's torso which may be activated by pressing the stomach area of the doll. The doll cries in response to actuation of this second switch. The crying of the doll may be interrupted by triggering of the laughing sound, but the crying sound may be triggered only when the doll is not laughing.

14 Claims, 3 Drawing Sheets

TOY DOLL HAVING SOUND GENERATOR WITH OPTICAL SENSOR AND PRESSURE SWITCHES

FIELD OF THE INVENTION

This invention relates to toys which generate sounds. In particular, this invention relates to a doll which generates a laughing or crying sound in response to differing light conditions and upon being physically stimulated by a human.

BACKGROUND OF THE INVENTION

There is known a number of dolls which respond to external stimuli and are intended to provide a life-like response.

U.S. Pat. No. 4,675,519 which issued Jun. 23, 1987 to Price describes a toy having an optically actuated sound generator. The patent specification discloses a doll having two optical sensing circuits including optical sensors in the eyes of the doll. The arrangement is such that a variation in sounds emitted from the doll is caused by a change in relative light intensities striking the sensors.

U.S. Pat. No. 4,249,338 which issued Feb. 10, 1981 to Wexler describes a doll having a sound generator and a number of switch means. There is a first switch for causing the doll to start to cry and other switches to stop the doll from crying, such as one located so as to be actuated by patting the doll's back.

SUMMARY OF THE INVENTION

The toy doll of the present invention has sound generating means for the generation of first and second sounds. The doll has an optical sensor which acts as a switch to trigger either of the sounds depending upon the absence or presence of light. There is a first pressure sensitive trigger connected to the sound generation means to trigger the first sound and a second pressure sensitive trigger connected to the sound generation means for triggering generation of the second sound.

The preferred first sound is a crying sound and preferably the second sound mimics human laughter. The disclosed embodiment has its optical sensor fixed in the mouth of the doll The absence of light triggers the crying sound while subsequent exposure to light causes the crying sound to cease and the baby to laugh. One of the pressure sensitive switches or triggers is located in the torso of the doll such that the doll may be poked in its tummy to cause the doll to emit crying sounds. The other of the pressure sensitive switches is located in the doll's torso such that the doll may be tickled at its side to cause the doll to laugh. The electronic arrangement is such that triggering of the laughter while the doll is crying will override the crying sounds.

DETAILED DESCRIPTION OF A PREFERRED EMBODIMENT

Figure 1:
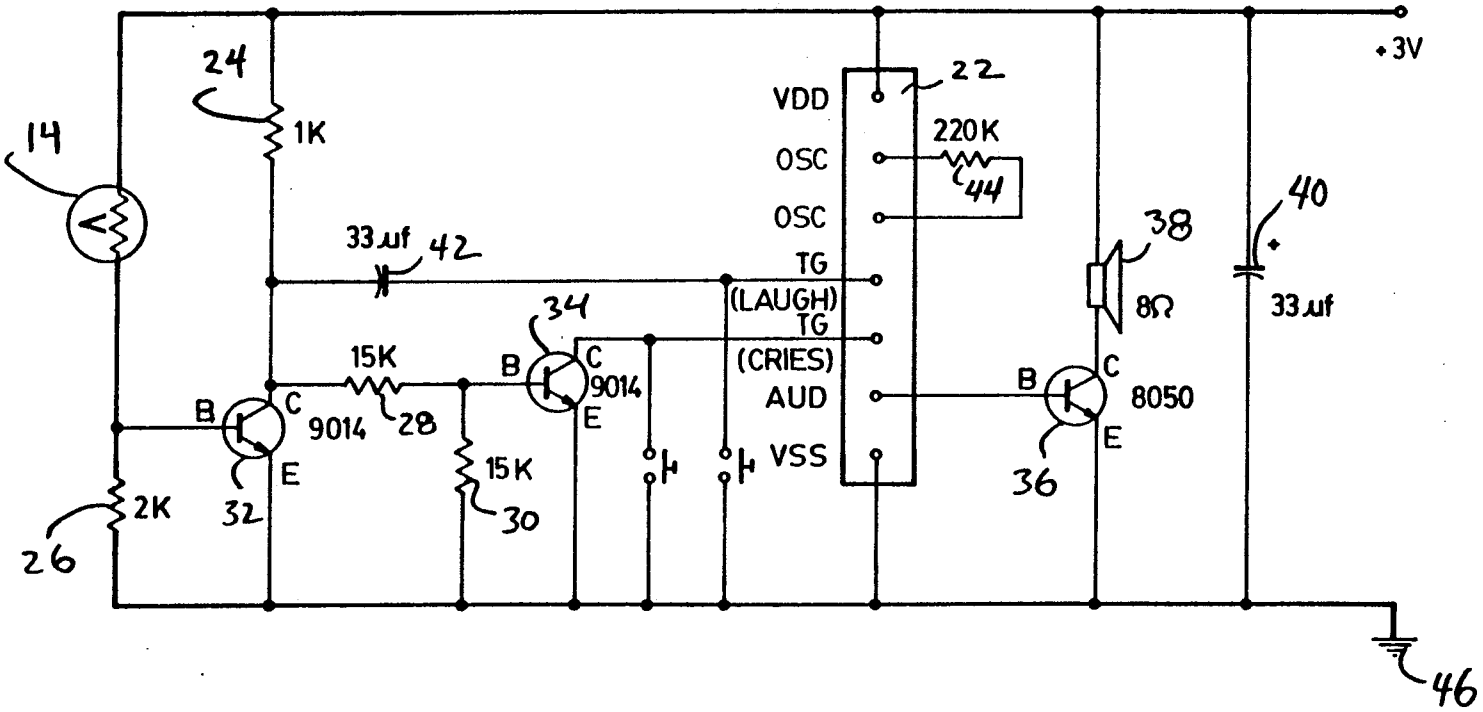
FIG. 1 is a circuit schematic of a preferred embodiment doll.
Figure 2:
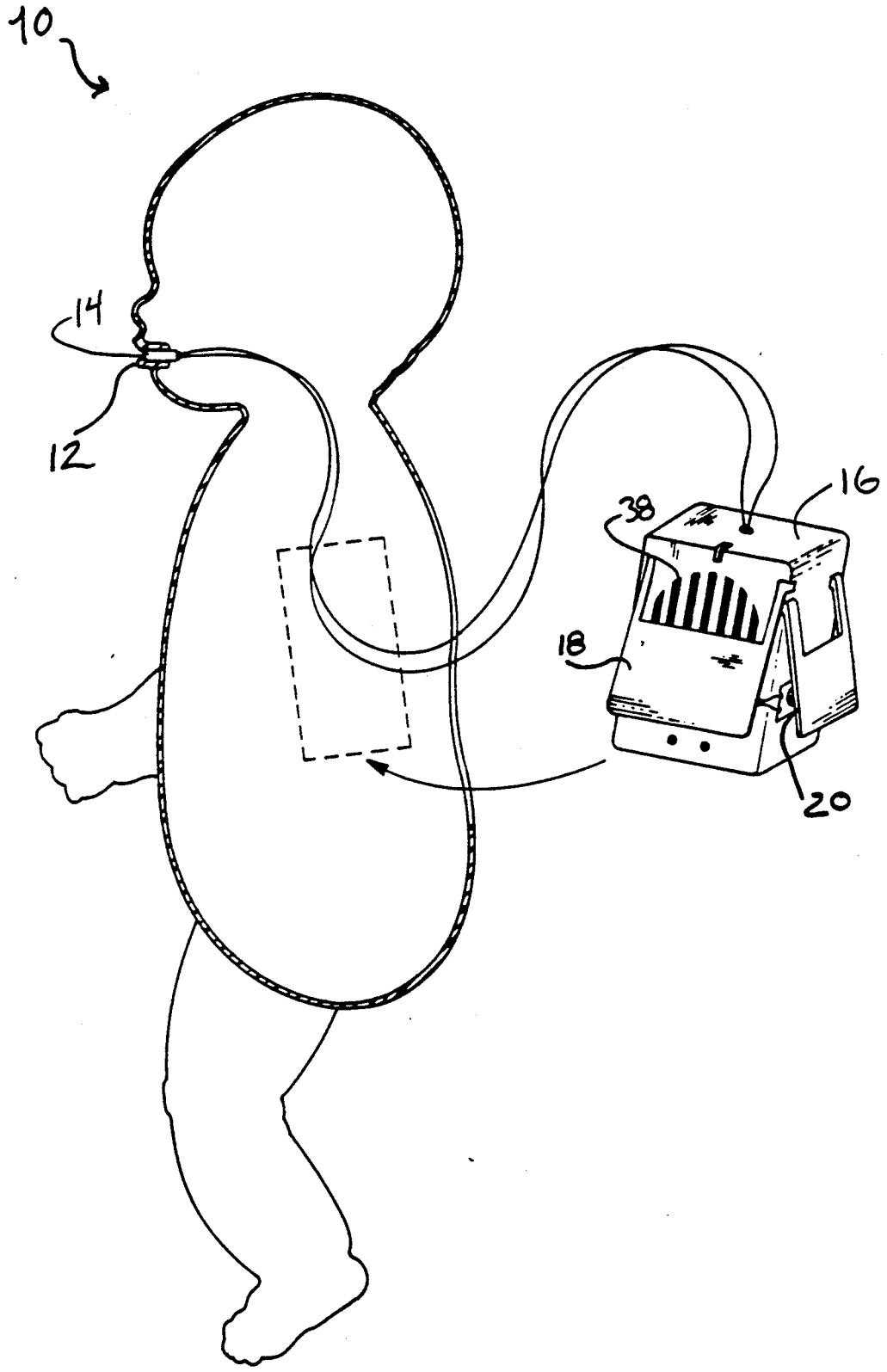
FIG. 2 is a partial cutaway of the preferred embodiment shown from the left side of the doll.

Turning to the figures, the electronic circuitry and related switching components of a preferred embodiment doll 10 are shown in FIG. 1, while the doll itself is shown in FIG. 2. Generally speaking, there are three means by which a child may cause the doll to emit a sound: fixed within mouth 12 of the doll is photosensor 14; located on the front exterior of plastic pack 16 is pressure sensitive switch 18; and located on the pack so as to be on the doll's left side is pressure sensitive switch 20. All of the circuitry components are located within pack 16, save for the sensor and switches.

As shown in FIG. 1, the doll's circuitry is powered by a 3V power source, preferably two 1.5 volt AA batteries, not shown. Photosensor 14 (part number A9009) provides a resistance of 300 ohms in the dark, which resistance increases when exposed to light to 100K. The circuitry includes integrated circuit 22 provided by the commercially available HT-82104 chip of Holtek Microelectronics Inc. available through Semic Technology Ltd., RM 2607-8 Ho King Comm. Ctr., 2-16 Fa Yuen St., Mongkok, Hong Kong. This is a speech synthesis chip, LSI implemented in C-MOS technology and includes a D/A converter and a speech ROM which can be configured by the manufacturer to produce sound patterns simulating crying and laughing. The arrangement is such that signals from switching components, described more fully below, are converted to an analog signal for sound generation. Further circuitry components include 1K resistor 24, 2K resistor 26, 15K resistors 28, 30, 9014 transistors 32, 34, amplifying 8050, transistor 36, 8 ohm speaker 38, 33 uf capacitors 40, 42 and 220K resistor 44. Capacitor 40 performs a smoothing function for starting and stopping the circuit and is connected between the power source and ground 46, while capacitor 42 is part of the timing circuit to control the crying and laughing duration and switching between the two. There is an on/off switch, not shown.

Figure 3:
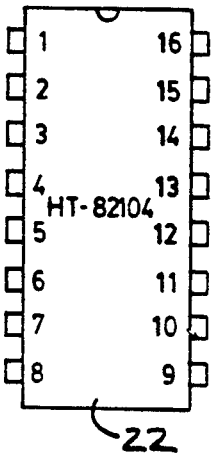
FIG. 3 shows the pin connection arrangement of the HT-82104 integrated circuit chip used in the preferred embodiment doll.

Connections to standard pin locations of the HT-82104 chip are shown in FIG. 3. Chip circuitry includes an oscillator, input and output OSC, to control the quality of the synthesized sound, which are connected externally in this application by 220K resistor 44 through pins 1 and 16. Positive power supply is connected at pin 15 and ground to pin 8. Switch means for activation of the laughing mode (LAUGH TG) are connected at pin 5 and crying mode (CRIES TG) at pin 4. Output to the speaker circuit portion (AUD) is at pin 6.

Low voltage (logic zero) at pin 4 actuates the crying mode of the doll while low voltage (logic zero) at Pin location 5 causes generation of a laughing sound. When photosensor 14 detects no light, the circuitry produces a logic zero at pin 4 and such that a crying sound is generated. Conversely when photosensor or light switch 14 detects light, a logic zero appears at pin 5, and a laughing sound is triggered. Laughing triggers will override crying triggers. Thus if photoswitch 14 detects no light, as when the doll is in a dark location or is left lying face down, the doll will emit a crying sound. If photosensor 14 is then exposed to light, that is, a child carries the doll into a lighted room or picks up the doll to expose the sensor to light, the doll will then emit a laughing sound for a short period of time and then will cease to emit noise. All this assumes no activation of the pressure sensitive switches during this sequence of events. If left in a position such that photoswitch 14 detects no light, and none of the other switches are actuated, switch 14 will continually trigger the crying sound and the doll will thus cry endlessly.

Pressure sensitive switch 18, if actuated when the doll is not emitting any sound, will cause a crying sound to be generated for a fixed period of time. Switch 18 is located on the front outer side of pack 16 situated in the doll's torso. Thus, if the doll is lying happily on its back in a lighted area (i.e., emitting no sound) and is poked in the stomach area so as to actuate switch 18, the doll will cry for a short period of time.

The arrangement is such that actuation of pressure sensitive switch 20 always causes the doll to laugh. Switch 20 is positioned on an outer side of pack 16 such that the switch may be pressed by applying pressure to the doll's left side, generally under its armpit. Thus, if the doll is lying quietly on its back and a child actuates switch 20 by tickling the doll's left side the doll will laugh for a fixed period of time. The doll thus displays life-like characteristics.

The speech ROM portion of the chip is programmed to produce a crying sound section which plays for approximately one second and repeats in a sequence of up to four times when the sound is triggered. The laughing sound plays in sections of about two seconds which sections are repeated up to three times.

The circuitry arrangement is such that if actuation of a switch which triggers the laughing sound occurs while the crying sound is being generated, the laughing sound will override the crying sound. The duration of the laughing sound (i.e., the number of laughing sound sections emitted) depends the point in the four sequential crying sound sections the that laughing sound switch is actuated. If a laughing sound switch is actuated during the emitting of the first of the four crying sound sections, then the first crying sound section will be completed and three laughing sound sections will be generated. If a laughing sound switch is actuated during the emitting of the second of the four crying sound sections, then the second crying sound section will be completed and only two laughing sound sections will be generated. If a laughing sound switch is actuated during the emitting of the third of the four crying sound sections, then the third crying sound section will be completed and only one laughing sound section will be generated. If a laughing sound switch is actuated during the emitting of the fourth of the four crying sound sections, then the fourth crying sound section will be completed and all three laughing sound sections will be sounded.

There is thus an apparent randomness to the laughing pattern of the doll when a switch which triggers laughter is actuated when crying sounds are already being emitted. This apparent random behavior contributes to the life-like behavior of the doll. The apparent random pattern arises because a child, once laughing has been triggered, will generally not be aware of which of the four crying sound sections this occurred in, as such awareness would require a conscious effort to count and keep track of the number of crying sound sections which have been emitted. A child who turns a light on in a dark room in which a crying doll is located will hear the doll laugh for one, two or three laughing sound sections after the crying has ceased, but will generally not be able to predict the extent of the laughter.

The circuitry is such that triggering of laughter will override crying, but not vice versa. A child may thus "tickle" the doll in the dark and the doll will laugh for a short period of time. If the doll remains in the dark, i.e., the light switch remains unexposed to light, then the doll will immediately start crying again when the laughter is complete. A child may poke the doll when silent in the tummy to trigger crying and then tickle the doll to cause the doll to laugh, but poking a laughing doll in the tummy will not make it cry. Trigger 18 will cause generation of crying only if actuated when the doll is not laughing. The unidirectional, or non-symmetrical nature of the override also contributes to the life-like behavior of the doll.

It will be further appreciated that the life-like nature of the doll stems from location of the switches. Covering the face of the doll to shield sensor 14 from light would generally be considered to cause discomfort and this causes the doll to cry and makes the doll seem human-like. Similarly, many humans dislike being poked in the tummy and that this causes the doll to cry makes the doll seem human-like. Human babies often respond to tickling of their torso sides by laughing and the doll mimics human behavior in this regard also.

Persons skilled in the art would be capable of obtaining variations in the behavior of the disclosed doll, as well as being capable of varying the number and placement of switches without departing from the scope of this invention, which is defined by the claims which follow.

What is claimed is:

1. A toy doll comprising:

sound generating means for generation of first and second sounds;

an optical sensor, electronically connected to the sound generating means, for triggering the generation of the first sound in response to the absence of light striking the sensor and the generation of the second sound in response to light striking the sensor, the first sound comprising at least two first sound sections and the second sound comprising at least two second sound sections; and a first pressure sensitive trigger, electronically connected to the sound generating means, for triggering the generation of the second sound in response to depression of the trigger; and wherein triggering the generation of the second sound during generation of the first sound overrides the generation of the first sound; and the point where the generation of the second sound is triggered determines the number of the second sound sections then sounded.

2. The toy doll of claim 1 wherein each of the first sound sections resembles a crying noise.

3. The toy doll of claim 2 wherein each of the second sound sections resembles a laughing noise.

4. The toy doll of claim 3 further comprising a second pressure sensitive trigger, electronically connected to the sound generating means, for triggering the generation of the first sound in response to depression of the second trigger.

5. The toy doll of claim 4 wherein the second number is no greater than the first number.

6. The toy doll of claim 5 wherein the first number is greater than the second number.

7. The toy doll of claim 1 wherein the generation of the first sound in response to the absence of light striking the optical sensor is continued until overridden by triggering of the generation of the second sound.

8. The toy doll of claim 4, further comprising a pack located in the doll torso, wherein the first and second pressure sensitive triggers are located on the exterior of the pack.

9. The toy doll of claim 8 wherein the second trigger is positioned to be actuated by pressure applied to a frontal torso area.

10. The toy doll of claim 9 wherein the first trigger is positioned to be actuated by pressure applied to a side of the torso.

11. The toy doll of claim 1 wherein the doll has a mouth and the optical sensor is fixed therewithin.

12. The toy doll of claim 6 wherein there are four first sound sections.

13. The toy doll of claim 12 wherein there are three second sound sections.

14. A toy doll comprising:

sound generating means for generation of first and second sounds;

an optical sensor, electronically connected to the sound generating means, for triggering the generation of the first sound in response to the absence of light striking the sensor and the generation of the second sound in response to light striking the sensor, the first sound comprising a first sound section repeated in a sequence of a fixed first number of times and the second sound comprising a second sound section sounded up to a fixed second number of times;

a first pressure sensitive trigger, electronically connected to the sound generating means, for triggering the generation of the first sound in response to depression of the trigger; and a second pressure sensitive trigger, electronically connected to the sound generating means, for triggering the generation of the second sound in response to depression of the second trigger; and wherein triggering the generation of the second sound during generation of the first sound overrides the generation of the first sound and which in the sequence of first sound sections during which generation of the second sound is triggered determines the number of times the second sound section is then sounded.

* * * * *